United States Patent [19]

Zandel

[11] Patent Number: 4,729,234

[45] Date of Patent: Mar. 8, 1988

[54] BUILT-IN LIFTING AND MANIPULATING HYDRAULIC JACKS FOR CROSSHEADS OF HEAVY HYDRAULIC PRESSES

[75] Inventor: Adam Zandel, Forest Hills, N.Y.

[73] Assignee: Press Technology Corporation, White Plains, N.Y.

[21] Appl. No.: 844,898

[22] Filed: Mar. 27, 1986

[51] Int. Cl.[4] ..... B21D 37/12

[52] U.S. Cl. ..... 72/455; 52/749; 100/214; 248/678; 248/637; 29/402.08

[58] Field of Search ..... 72/446, 448, 455, 456, 72/453.09, 453.11, 417, 419; 52/749; 100/214, 276, 269 R; 248/678, 679, 637; 29/402.08

[56] References Cited

U.S. PATENT DOCUMENTS

| | | | |
|---|---|---|---|
| 1,999,249 | 4/1935 | Meyercord et al. | 100/214 |
| 3,316,749 | 5/1967 | Beard | 72/455 |
| 3,802,150 | 4/1974 | Melton et al. | 52/749 |
| 3,931,728 | 1/1976 | Trolle | 72/447 |
| 3,969,921 | 7/1976 | Jonsson et al. | 72/455 |

*Primary Examiner*—Robert L. Spruill
*Assistant Examiner*—David B. Jones
*Attorney, Agent, or Firm*—Ostrolenk, Faber, Gerb & Soffen

[57] ABSTRACT

Hydraulic jacks, stands and other support structures for temporarily supporting and/or lifting the crosshead of a forging press or other components thereof are built-in at the foundation pit of the forging press. As the need arises to support or lift the lower crosshead during maintenance, repair or daylight adjustment procedures, the support and lifting implements can be rolled from under specially provided alcoves in the foundation pit to predetermined locations under the forging press. The permanent location of the support implements in the foundation pit reduces the down time of the forging press from a week or more to about one or two days.

7 Claims, 2 Drawing Figures

BUILT-IN LIFTING AND MANIPULATING HYDRAULIC JACKS FOR CROSSHEADS OF HEAVY HYDRAULIC PRESSES

BACKGROUND OF THE INVENTION

The present invention is related to large, up to 500 kiloton, forging presses and more particularly to a built-in lifting and manipulating structure which is permanently installed in the foundation pit of the forging press to reduce the down time of certain press maintenance operations.

The present invention is closely related to the subject matter described in patent application Ser. No. 821,790 entitled "A FORGING PRESS WITH ADJUSTABLE DAYLIGHT AND WITH YOKE DESIGN FOR ATTACHING TIE-RODS TO CROSSHEADS" which is commonly assigned with the present application. The subject matter thereof is incorporated herein by reference.

Forging presses are used for shaping metallic workpieces into end products of desired shape by pressing said pieces between a pair of dies to give them an intended shape.

Forging presses are large structures, equivalent to a multistory building, and it is common to house a portion of the forging press in a foundation pit below ground.

As described, for example in the aforementioned patent application, one of the major structures of the forging press is its frame which includes a horizontally extending lower crosshead assembly extending generally parallel to the floor of a main chamber in the foundation pit and a pair of vertical columns, often referred to as tie-rods, connected to opposite ends of the lower crosshead assembly and, at their other ends to an upper crosshead assembly located above ground level. The massive size of such a frame and its weight which easily exceeds many hundreds, or even thousands, of tons, pose a difficult problem whenever the frame components must be disassembled for either maintenance, repair or adjustments. It is not unusual that a disassembly of even a portion of the frame requires an entire week and sometimes several weeks and results in a very costly loss of forging press availability.

SUMMARY OF THE INVENTION

Accordingly, it is an object of the present invention to provide built-in support, lifting and manipulating implements located in the foundation pit of the forging press which are readily available for supporting, lifting of otherwise manipulating the forging press components during any disassembly thereof.

It is another object of the present invention to provide a frame structure located in the foundation pit of the forging press for guiding and positioning the support and lifting implements to predetermined locations relative to the forging press.

The foregoing and other objectives of the present invention are realized with a forging press in accordance with the present invention whose foundation pit is formed with alcoves or niches along the sides thereof wherein a plurality of support and lifting implements such as hydraulic jacks, stands or the like are stored. A guiding frame structure on the floor of the foundation pit supports the various implements and is movable to predetermined locations under the forging press. The implements are arranged on the frame in a predetermined order such that when the frame, which can be supported on rollers or casters, is moved under the frame all of the implements are already in place relative to predetermined points on the forging press.

Alternatively, or complementing the foregoing, an arrangement of guiding rails can be provided along the floor of the foundation pit. The support and lifting implements are movable along the guiding rails. When not in use, the implements are pushed back by appropriate jacks to locations out of the way of the forging press. This simple but very helpful concept of readily provided lifting tools in the foundation pit can reduce the time for disassembly and later, reassembly of frame components to one or two days instead of the usual week or more. The arrangement is particularly useful in relation to the forging press described in the aforementioned patent application which may be provided with an adjustable daylight and which, for changing daylight from one setting to another, would require supporting of the lower crosshead of the frame while the tie-rod columns are detached therefrom.

Other features and advantages of the present invention will become apparent from the following description of a preferred embodiment thereof which is provided below in relation to the appended drawings.

DETAILED DESCRIPTION OF A PREFERRED EMBODIMENT

Figure 1:
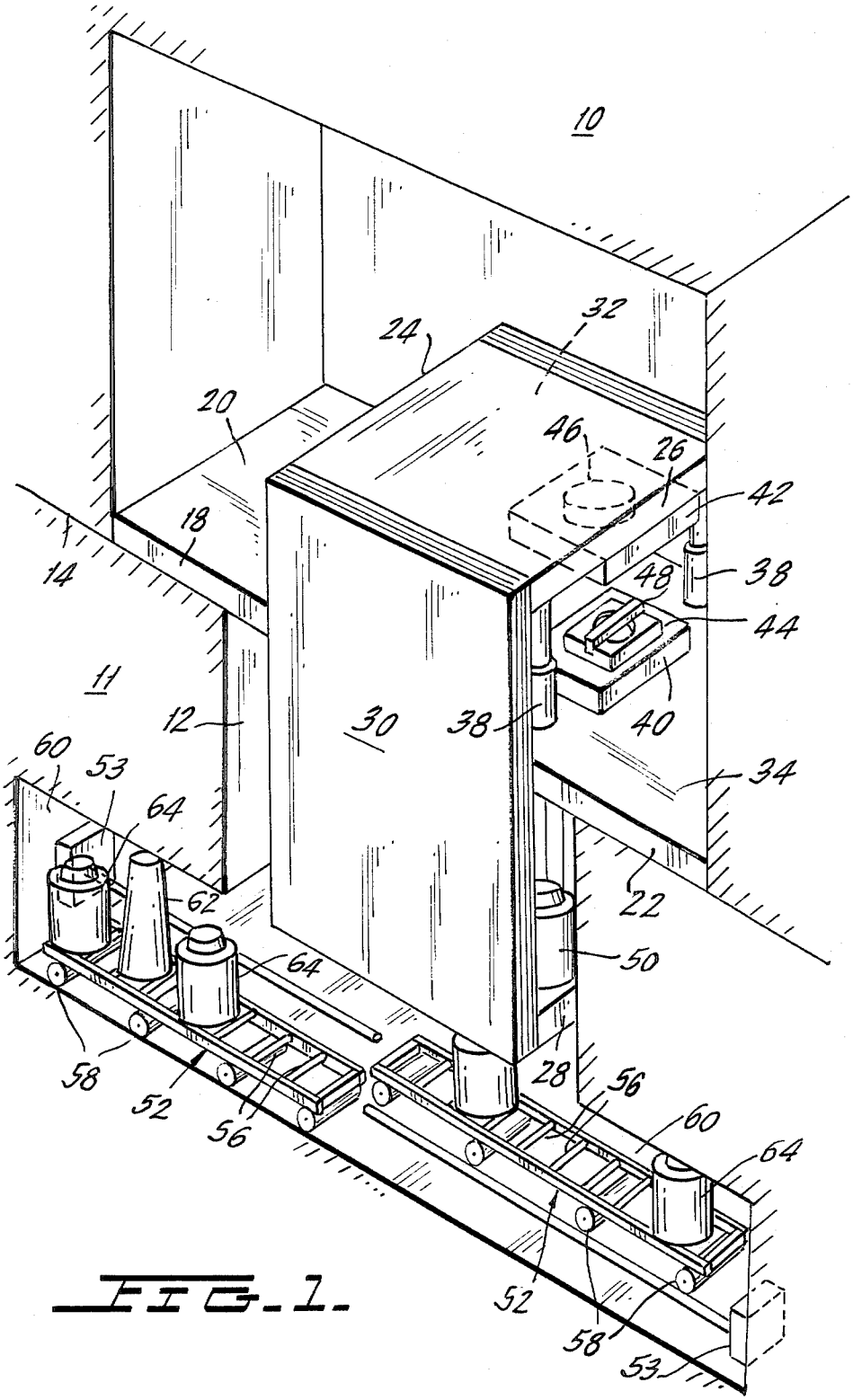
FIG. 1 illustrates perspectively, by means of a simplified schematic, a forging press of the pulldown design and illustrates a frame on the foundation floor and support and lifting implements on the frame.
Figure 2:
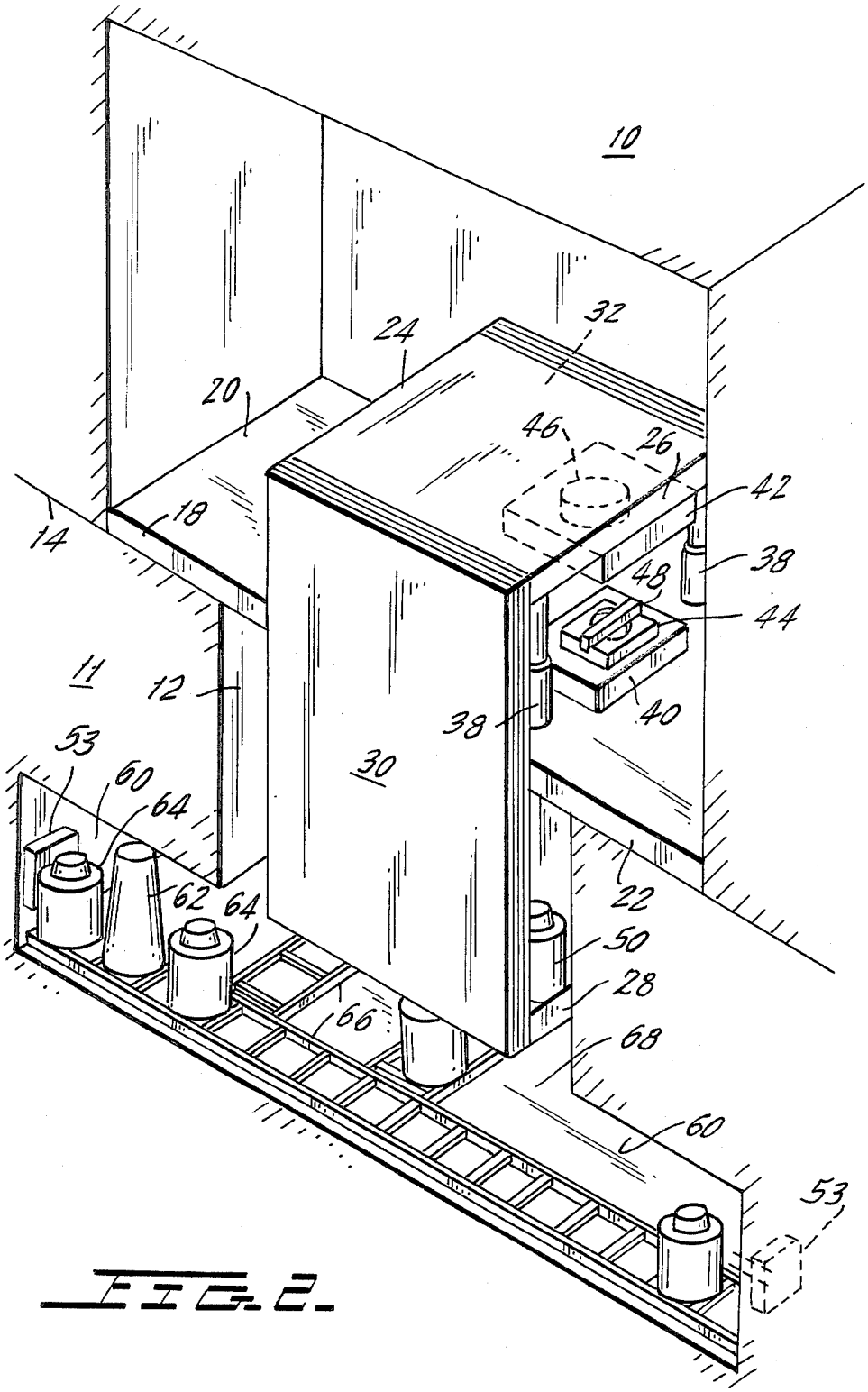
FIG. 2 is similar to FIG. 1 except that the support and lifting implement are guided along guide rails.

It should be noted at the outset that FIGS. 1 and 2 are in part schematically drawn to show a forging press. The press portion of the figures is too simplified to correspond to any known construction of a forging press. Nevertheless, the figures are well adapted for explaining the principle of operation of a pull-down forging press. The main objective in presenting the figures is to show a foundation pit stocked with support and lifting implements and means for positioning these implements relative to the forging press.

The forging press that will now be described in reference to FIG. 1 is of the pull-down type although the concept of the present invention is equally applicable to either stationary or pull-down forging presses.

Forging press facility 10 is housed in a building structure for a forging press having a foundation pit 12 below ground level 14 and a main building 16 above ground level. A bridge 18 extends across foundation pit 12 and is supported at its ends 20 and 22 by the building structure at about ground level.

A frame 24 surrounds bridge 18 and includes an upper crosshead assembly 26 above the bridge, a lower crosshead assembly 28 below bridge 18 and first and second tie-rod assemblies 30 and 32 for connecting the upper and lower crossheads 26 and 28 to one another to complete the frame structure. The frame 24 is movable up and down in a manner which permits the upper crosshead 26 to be raised and lowered with respect to the top 34 of bridge 18.

A plurality of return cylinders 38 extend between the top 34 of bridge 18 and the upper crosshead assembly 26 for supporting the upper crosshead assembly 26 above a workpiece platen 40 which is located on bridge 18. An upper plate 42 is secured to the upper crosshead assembly 26 and projects above workpiece platen 40. Workpiece platen 40 and upper platen 42 support, respectively, an upward facing bottom die half 44 and a downward facing top die half 46. A metallic workpiece 48 is located between the two die halves 44 and 46 to be compressed therebetween to form an end product having an intended shape. During a forging cycle, main cylinders 50 push frame 24 downwardy while the pressure in return cylinders 38 is relaxed. The operation will result in the forging of metallic workpiece 48.

A guiding frame 52 includes a pair of longitudinally extending main bars and a plurality of cross bars 56. The guiding frame is supported on a plurality of rollers 58 or casters which enable it to be mvoed from under alcove 60 to under the frame 24, when needed.

Support and lifting implements including stands 62, hydraulic jacks 64 all of which are designed to support heavy loads are disposed along guiding frame 52. When the need arises to support or raise sections of frame 24 of the forging press, guiding frame 52 is moved by several available means including horizontally disposed jacks which allow it to be pushed outside alcove 60 and under the press. The guiding frame 52, carrying the support implements, comes to rest at such locations under the frame or alongside thereof so that each stand 62 or hydraulic jack 64 is already disposed against predetermined points of the forging press. Note that the location of guiding frame 52 and the tools located thereon is for illustrative purposes only and that a plurality of such arrangements disposed at several key locations in the foundation pit will be provided. The jacks 53 represent means for moving the guiding frame 52 out of the alcoves 60 and under the frame 24, when needed. The jacks 53 and guiding frame 52 can contact each other in any one of several manners which are well known to people skilled in the art.

The arrangement illustrated in FIG. 2 is similar to FIG. 1 with the exception that instead of guiding frame 52, a plurality of immovable guide rails 66 are arranged along the entire floor 68 of foundation pit 12. Stands 62 or hydraulic jacks 64 are movable along guide rails 66 to desired locations in a mode similar to the manner in which frame 52 is pushed, in a manner similar to the manner in which frame 52 is pushed as previously described. As in FIG. 1 horizontally disposed jacks 53 may be used for pushing stands 62 or hydraulic jacks 64 to desired locations under the frame 24. When the intended operation has been completed, the entire assembly of stand and lifting implements is returned to its storage location in alcoves or niches 60.

Although the present invention has been described in relation to preferred embodiments thereof, many other variations and modifications will now become apparent to those skilled in the art. It is therefore preferred that the present invention be limited not by the specific embodiments disclosed herein but only by the appended claims.

What is claimed is:

1. A forging press arrangement, comprising:

a foundation pit including a main chamber and alcoves along sides and a bottom region of said foundation pit;

a forging press having a horizontally extending lower crosshead portion of a press frame of said forging press, said lower crosshead being disposed in said foundation pit and generally upright tie-rod columns secured to opposite ends of said lower crosshead assembly;

a guiding frame structure disposed on a floor of said foundation pit and a plurality of support and lifting implements supported on said guiding frame structure, said guiding frame structure and said support and lifting implements being provided solely for carrying out repair and maintenance of said forging press and being independent of and constituting non-operational components of said forging press, said support and lifting implements being stored, during periods of non-use in said alcoves; and means for moving selected ones of said implements to predetermined locations under said press frame of said forging press whereby said implements are effective to assist in carrying out repair and maintenance of said forging press.

2. A forging press arrangement as in claim 1 wherein said guiding frame structure comprises spaced longitudinal metallic bars, a plurality of crossbars extending between said longitudinal bars, a rolling means located under said guiding frame to permit said guiding frame to be rolled along the floor of said foundation pit, said implements being positioned at predetermined locations on said guiding frame and means for moving said guiding frame to a predetermined location relative to said press frame so that said implements will be positioned relative to said press frame in accordance with a predetermined arrangement.

3. The forging press arrangement as in claim 2 wherein said rolling means comprises a plurality of rollers under said guiding frame.

4. The forging press arrangement as in claim 2 wherein said rolling means comprises a plurality of casters under said guiding frame.

5. The forging press as in claim 1 wherein said guiding frame comprises guide rails disposed along the floor of said foundation pit, and means for moving said support and lifting implements along said guide rails to predetermined positions relative to said forging press.

6. The forging press arrangement as in claim 1 wherein said implements comprise stands.

7. The forging press arrangement as in claim 1 wherein said implements comprise hydraulic jacks.

* * * * *